US007789132B2

(12) United States Patent
Williams

(10) Patent No.: US 7,789,132 B2
(45) Date of Patent: Sep. 7, 2010

(54) STRIPPER RUBBER RETRACTING CONNECTION SYSTEM

(76) Inventor: John R. Williams, Georgetown, TX (US); Theresa J. Williams, legal representative, 505 W. 21st St., Georgetown, TX (US) 78626

( * ) Notice: Subject to any disclaimer, the term of this patent is extended or adjusted under 35 U.S.C. 154(b) by 260 days.

(21) Appl. No.: 11/897,116

(22) Filed: Aug. 29, 2007

(65) Prior Publication Data

US 2009/0057029 A1 Mar. 5, 2009

(51) Int. Cl.
*E21B 19/00* (2006.01)

(52) U.S. Cl. ..... 166/84.1

(58) Field of Classification Search ..... 166/81.1, 166/84.1, 88.1; 175/214
See application file for complete search history.

(56) References Cited

U.S. PATENT DOCUMENTS

| | | | | |
|---|---|---|---|---|
| 557,423 | A | 3/1896 | Outhouse et al. | |
| 1,037,072 | A | 8/1912 | Snyder | |
| 1,372,297 | A | 3/1921 | Kennedy | |
| 1,980,336 | A | 11/1934 | Hoagland | |
| 3,285,352 | A * | 11/1966 | Hunter | 175/214 |
| 3,796,448 | A | 3/1974 | Ringkamp | |
| 4,363,357 | A | 12/1982 | Hunter | |
| 4,526,243 | A | 7/1985 | Young | |
| 4,606,557 | A | 8/1986 | Coffey | |
| 4,658,894 | A * | 4/1987 | Craig | 166/84.1 |
| 4,743,079 | A | 5/1988 | Bloch | |
| 5,213,158 | A * | 5/1993 | Bailey et al. | 166/84.3 |
| 5,348,107 | A | 9/1994 | Bailey et al. | |
| 5,829,480 | A | 11/1998 | Smith, III | |
| 5,901,964 | A * | 5/1999 | Williams et al. | 277/326 |
| 6,230,824 | B1 | 5/2001 | Peterman et al. | |
| 2003/0121671 | A1 | 7/2003 | Bailey | |
| 2005/0173127 | A1 * | 8/2005 | Williams et al. | 166/378 |
| 2005/0183865 | A1 * | 8/2005 | Williams | 166/387 |
| 2005/0236836 | A1 * | 10/2005 | Williams | 285/404 |
| 2007/0125548 | A1 * | 6/2007 | Williams | 166/379 |
| 2007/0144786 | A1 | 6/2007 | Williams | |

* cited by examiner

*Primary Examiner*—William P Neuder
(74) *Attorney, Agent, or Firm*—David O. Simmons

(57) ABSTRACT

An adapter comprises a generally cylindrical adapter, engagement member bores, retention member bores, and an attachment structure configured for allowing the adapter to be fixedly attached to a mating portion of the drilling head equipment. The engagement member bores extend effectively parallel to the central bore. The retention member bores are each adjacent a respective one of the engagement member bores. The retention member bores are positioned such that the engagement pin bores and retention member bores intersect. The retention member bore is configured for having a retention member engaged therein in a manner allowing the retention member to be selectively displaced along a length of the retention member bore. The adapter includes a central bore to accommodate a down hole tubular. The attachment structure includes a surface adjacent the central bore comprising fastener bores substantially parallel to the central bore for facilitating connection of the adapter to the drilling head equipment.

12 Claims, 4 Drawing Sheets

STRIPPER RUBBER RETRACTING CONNECTION SYSTEM

FIELD OF THE DISCLOSURE

The present disclosure relates to connectors and connector systems for making mechanical connections. More particularly, the disclosure provides apparatus, systems and methods for connecting or disconnecting a stripper rubber to or from equipment, such as a bearing assembly, of a drilling head to pressure-seal the interior of a well bore for the circulation, containment or diversion of drilling fluid through the well during drilling operations.

BACKGROUND

Oil, gas, water and geothermal wells are typically drilled with a drill bit connected to a hollow drill string which is inserted into a well casing cemented in the well bore. A drilling head is attached to the well casing, wellhead or to associated blowout preventer equipment, for the purposes of sealing the interior of the well bore from the surface and facilitating forced circulation of drilling fluid through the well while drilling or diverting drilling fluids away from the well. Drilling fluids include, but are not limited to, water, steam, drilling muds, air, and other gases.

In the forward circulation drilling technique, drilling fluid is pumped downwardly through the bore of the hollow drill string, out the bottom of the hollow drill string and then upwardly through the annulus defined by the drill string and the interior of the well casing, or well bore, and subsequently out through a side outlet above the well head. In reverse circulation, a pump impels drilling fluid through a port, down the annulus between the drill string and the well casing, or well bore, and then upwardly through the bore of the hollow drill string and out of the well.

Drilling heads typically include a stationary body, often referred to as a bowl, which carries a rotatable spindle such as a bearing assembly, rotated by a kelly apparatus or top drive unit. One or more seals or packing elements, often referred to as stripper packers or stripper rubbers, is carried by the spindle to seal the periphery of the kelly or the drive tube or sections of the drill pipe, whichever may be passing through the spindle and the stripper rubber, and thus confine or divert the core pressure in the well to prevent the drilling fluid from escaping between the rotating spindle and the drilling string.

As modern wells are drilled ever deeper, or into certain geological formations, very high temperatures and pressures may be encountered at the drilling head. These rigorous drilling conditions pose increased risks to rig personnel from accidental scalding, burns or contamination by steam, hot water and hot, caustic well fluids. There is a danger of serious injury to rig workers when heavy tools are used to make a stripper rubber connection at the drilling head. The connection should be made quickly and achieve a fluid tight seal.

Rotating blowout preventers and diverters are well known to those of ordinary skill in the art of well pressure control. Rotation of the diverter/preventer is facilitated by a sealing engaged bearing assembly through which the drill string rotates relative to the stationary bowl or housing in which the bearing assembly is seated. Typically, a rubber O-ring seal, or similar seal, is disposed between the stripper rubber and the bearing assembly to improve the fluid-tight connection between the stripper rubber and the bearing assembly.

Pressure control is achieved by means of one or more stripper rubbers connected to the bearing assembly and disposed around the drill string. At least one stripper rubber rotates with the drill string. Stripper rubbers typically taper downward and include rubber or other resilient substrate so that the downhole pressure pushes up on the rubber, pressing the rubber against the drill string to achieve a fluid-tight seal. Stripper rubbers often further include a metal insert that provide support for bolts or other attachment means and which also provide a support structure to minimize deformation of the rubber cause by down hole pressure forces acting on the rubber.

Stripper rubbers are connected or adapted to equipment of the drilling head to establish and maintain the pressure control seal around a down hole tubular (i.e., a drill string). It will be understood by those skilled in the art that a variety of means are used to attach a stripper rubber to associated drilling head equipment. Such attachment means include bolting from the top, bolting from the bottom, screwing the stripper rubber directly onto the equipment via cooperating threaded portions on the top of the stripper rubber and the bottom of the equipment, and clamps.

It will be understood that, depending on the particular equipment being used at a drilling head, a stripper rubber at one well may be connected to equipment specific to that well while at another well a stripper rubber is connected to different equipment. For example, at one well the stripper rubber may be connected to the bearing assembly while at another well the stripper rubber may be connected to an inner barrel or an accessory of the drilling head. While the present disclosure is made here in relation to connecting the stripper rubber to the bearing assembly, it will be evident that the disclosure contemplates connection of the stripper rubber to any selected equipment of the drilling head.

It is common practice to tighten the bolts or screws of the connection with heavy wrenches and sledge hammers. The practice of using heavy tools to tighten a bolt, for example, can result in over-tightening, to the point where the threads or the bolt head become stripped. The results of over-tightening include stripped heads, where the bolt or screw cannot be removed, or stripped threads, where the bolt or screw has no grip and the connection fails. Both results are undesirable.

Even worse, vibration and other drilling stresses can cause bolts or screws to work themselves loose and fall out. If one or more falls downhole, the result can be catastrophic. The drill bit can be ruined. The entire drillstring may have to tripped out, and substantial portions replaced, including the drill bit. If the well bore has been cased, the casing may be damaged and have to be repaired.

Drilling head assemblies periodically need to be disassembled to replace stripper rubbers or other parts, lubricate moving elements and perform other recommended maintenance. In some circumstances, stripped or over tightened bolts or screws make it very difficult if not impossible to disengage the stripper rubber from the drilling head assembly to perform recommended maintenance or parts replacement.

It is desirable, therefore, to obtain a connector for optionally connecting a stripper rubber assembly to a bearing assembly, or other equipment, of a drilling head that is effective, safe, simple, fast and elegant.

SUMMARY OF THE DISCLOSURE

In view of the foregoing, the present invention, through one or more of its various aspects, embodiments and/or specific features or sub-components, is thus intended to bring out one or more of the advantages that will be evident from the disclosures made herein. More specifically, the present invention facilitates connection of a stripper rubber to drilling head equipment. Embodiments of the present invention provide a fast, simple and reliable means for detachably attaching the stripper rubber to drilling head equipment and facilitating transmission of rotary torque loads applied on the stripper rubber from the rotating drill string and exerted from the stripper rubber onto a corresponding rotating component of the drilling head equipment (e.g., an inner barrel of the rotating control head).

In one embodiment of the present invention, a system is provided for disconnectably connecting a stripper rubber to drilling head equipment. The system comprises a stripper rubber, an adapter and a plurality of retention members. The stripper rubber includes an insert that has one or more engagement members extending vertically therefrom. The adapter is configured for being connected between the drilling head equipment and the stripper rubber. The adapter includes a central bore, engagement member bores substantially parallel to the central bore, retention member bores substantially perpendicular to the central bore, and attachment means configured for allowing the adapter to be fixedly attached to a mating portion of the drilling head equipment. Each one of the engagement member bores intersects a respective one of the retention member bores. Each one of the retention members is retractably engagable within a respective one of the retention member bores. Each one of the retention members lockingly engages a respective one of the engagement members upon sufficient displacement in a first direction within the respective one of the retention member bores thereby precluding withdrawal of the respective one of the engagement members from within the respective one of the engagement member bores. Each one of the retention members disengages from the respective one of the engagement members upon sufficient displacement in a second direction within the respective one of the retention member bores thereby allowing withdrawal of the respective one of the engagement members from within the respective one of the engagement member bores.

In another embodiment of the present invention, an adapter is provided for selectively connecting a stripper rubber to drilling head equipment of a well. The adapter comprises a central bore, an engagement member bore, a retention member bore, and a drill head equipment engaging structure. The central bore is configured to accommodate a down hole tubular. The engagement member bore extends effectively parallel to the central bore. The retention member bore is adjacent the engagement member bore. The drill head equipment engaging structure is adjacent the central bore. The retention member bore is positioned such that the engagement member bore and the retention member bore intersect. The retention member bore is configured for having a retention member engaged therein in a manner allowing the retention member to be selectively displaced along a length of the retention member bore. The drill head engaging structure is configured for being engaged with a mating portion of the drilling head equipment for attaching the adapter to the drilling head equipment.

In another embodiment of the present invention, an adapter is provided for selectively connecting a stripper rubber to drilling head equipment of a well. The adapter comprises a generally cylindrical adapter, engagement member bores, retention member bores, and attachment means configured for allowing the adapter to be fixedly attached to a mating portion of the drilling head equipment. The engagement member bores extend effectively parallel to the central bore. The retention member bores are each adjacent a respective one of the engagement member bores. The retention member bores are positioned such that the engagement member bores and retention member bores intersect. The retention member bore is configured for having a retention member engaged therein in a manner allowing the retention member to be selectively displaced along a length of the retention member bore. The adapter includes a central bore to accommodate a down hole tubular. The attachment means includes a surface adjacent the central bore comprising a plurality of fastener bores substantially parallel to the central bore for facilitating connection of the adapter to the drilling head equipment.

These and other objects, embodiments, advantages and/or distinctions of the present invention will become readily apparent upon further review of the following specification, associated drawings and appended claims.

BRIEF DESCRIPTION OF THE DRAWINGS

The present disclosure is further made in the detailed description that follows, by reference to the noted drawings, by way of non-limiting examples of embodiments in which like reference numerals represent similar parts throughout several views of the drawings, and in which.

DETAILED DESCRIPTION

Figure 1:
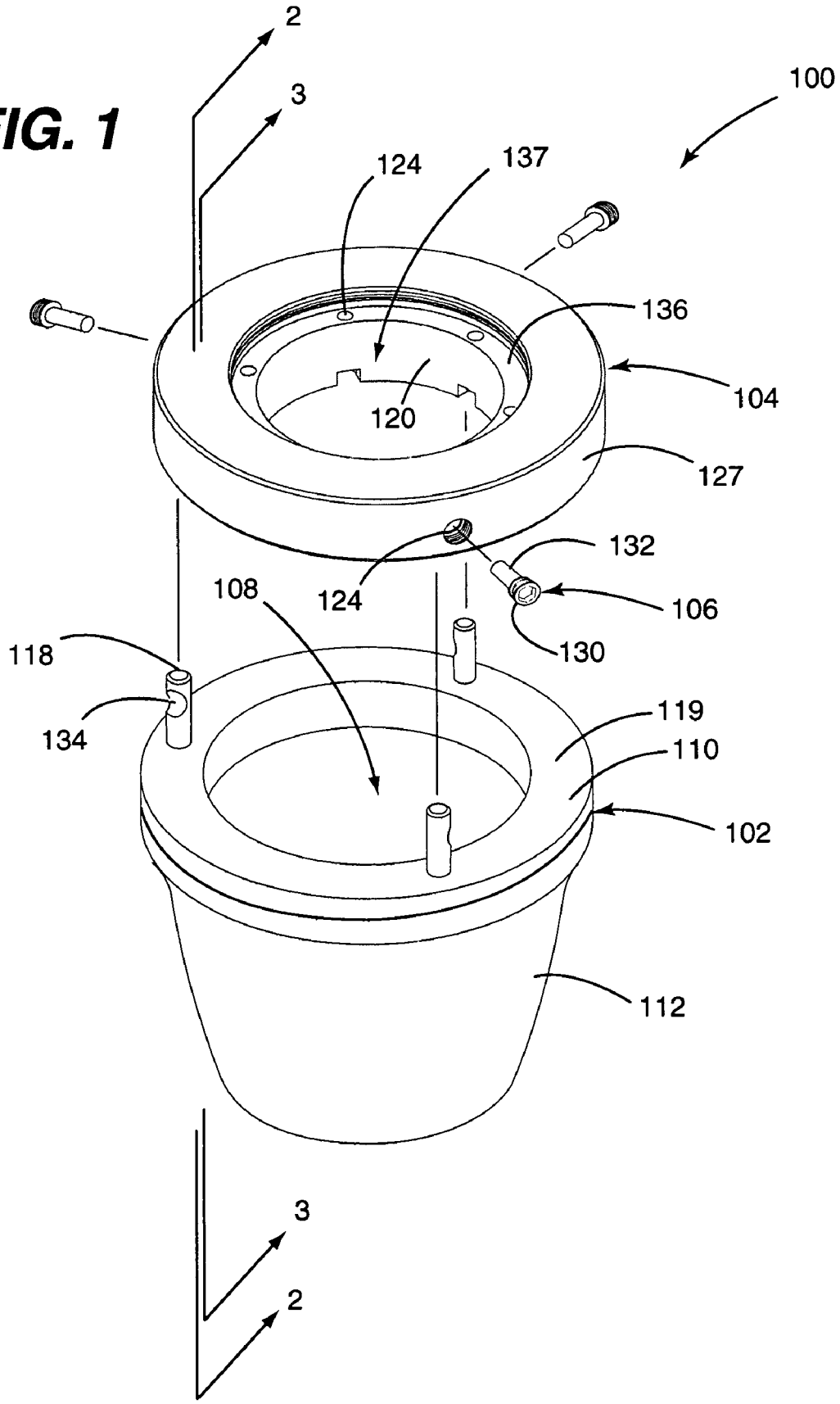
FIG. 1 shows a first embodiment of a stripper rubber connection system in accordance with the present invention.

Referring to FIG. 1, an embodiment of a system 100 for disconnectably connecting a stripper rubber to drilling head equipment in accordance with the present invention is shown. The system 100 includes a stripper rubber 102, an adapter 104 and a plurality of retention members 106. As is discussed below in greater detail, the stripper rubber 102, the adapter 104 and the retention members 106 are jointly configured for being interconnected in a manner that is advantageous, novel and non-obvious. Aspects of the present invention that contribute to such advantageous, novel and non-obvious interconnection include, but are not limited to, such interconnection providing a fast, simple and reliable means for detachably attaching the stripper rubber 102 to the adapter 104 in a manner that facilitates transmission of rotary torque loads applied on the stripper rubber 102 from a rotating drill string (not shown) that extends through a central bore 108 of the stripper rubber 102.

The stripper rubber 102 includes an insert 110 and a stripper rubber body 112. In a typical stripper rubber, the insert 110 is made from steel and the stripper rubber is made from an elastomeric material (e.g., synthetic rubber). The insert 110 includes a mechanical bonding portion 114 and an adapter engaging portion 116. The stripper rubber body 112 is formed over the mechanical bonding portion 114 and can optionally be formed over the at least a portion of the adapter engaging portion 116. Preferably, the mechanical bonding portion 114 includes one or more features that enhance the mechanical interface between the stripper rubber body material and the insert 110. Examples of the mechanical interface enhancing features include undercuts, windows, passages and the like.

In addition to mechanical interface enhancing features, it is also known to coat all or a portion of an insert with a bonding agent that enhances adhesion between the stripper rubber body material and the insert.

Engagement pins 118 are fixedly attached to the insert 110. The engagement pins 118 extend vertically from an upper face 119 of the adapter engaging portion 116. Preferably, but not necessarily, the engagement pins 118 are uniformly spaced apart. The term "pin" is disclosed herein to be broadly construed to include any suitable engagement member configuration for carrying out the intended functionality. Means for attaching the engagement pins 118 to the insert 110 are well known (e.g., threaded interface, welding, etc).

Referring now to FIGS. 1-5, the adapter 104 is configured for being connected between drilling head equipment (e.g., an inner barrel, spindle, etc) and the stripper rubber 102. To this end, the adapter 104 is configured for being attached to the drilling head equipment and for having the stripper rubber 102 attached thereto. The adapter 104 is not limited to a particular means for facilitating attachment to the drilling head equipment. Various known means and yet to be conceived means for attachment will suitably facilitate such attachment.

The adapter 104 includes a central bore 120, engagement pin bores 122, and retention member bores 124. The engagement pin bores 122 extend substantially parallel to the central bore 120 through a stripper rubber engaging face 126 of the adapter 104 (i.e., a bottom face). The stripper rubber engaging face 126 and the adapter engaging portion 116 of the stripper rubber 102 are jointly configured for being in abutted engagement.

The retention member bores 124 extend substantially perpendicular to the central bore 120. Each one of the retention member bores 124 extends through an exterior side face 127 of the adapter 104 and intersects a respective one of the engagement pin bores 122 to form a respective aperture 128 therebetween. Each one of the retention members 106 engages the respective one of the engagement pins 118 through the respective aperture 128 when the engagement pins 118 are positioned within the engagement pin bores 122 and the retention members 106 are then secured in the retention member bores 124.

Figure 3:
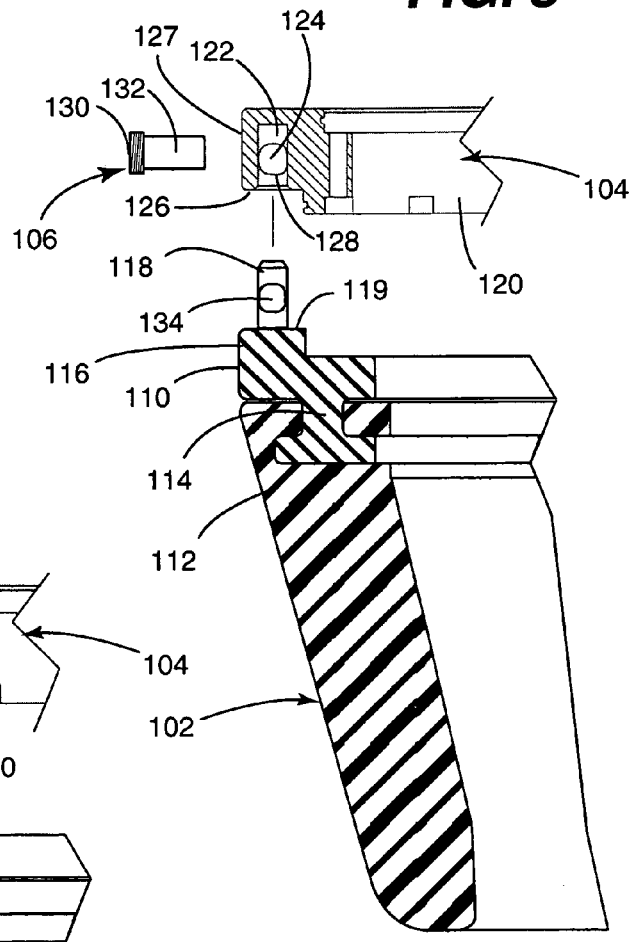
FIG. 3 is a cross-sectional view taken along the line 3-3 in FIG. 1.
Figure 2:
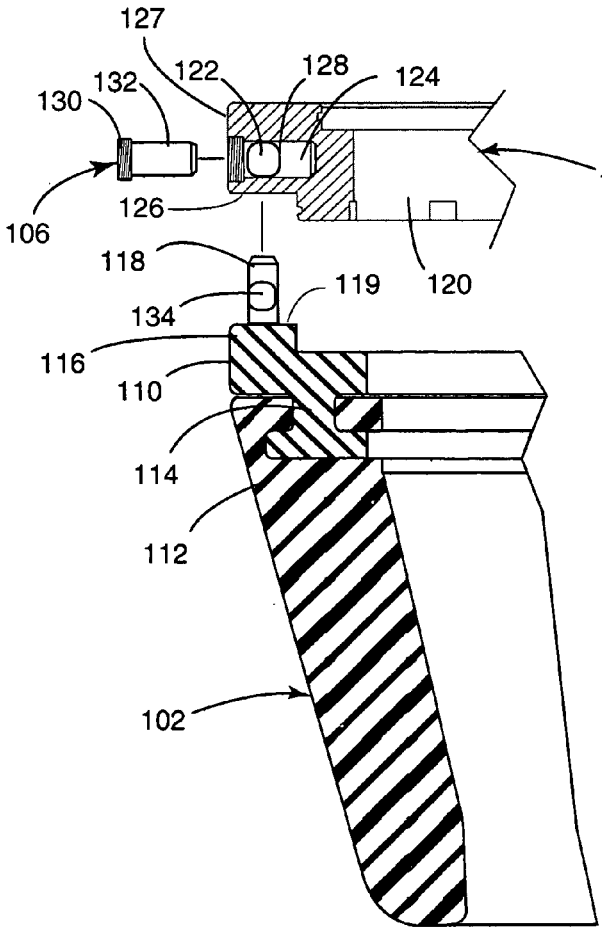
FIG. 2 is a cross-sectional view taken along the line 2-2 in FIG. 1.
Figure 4:
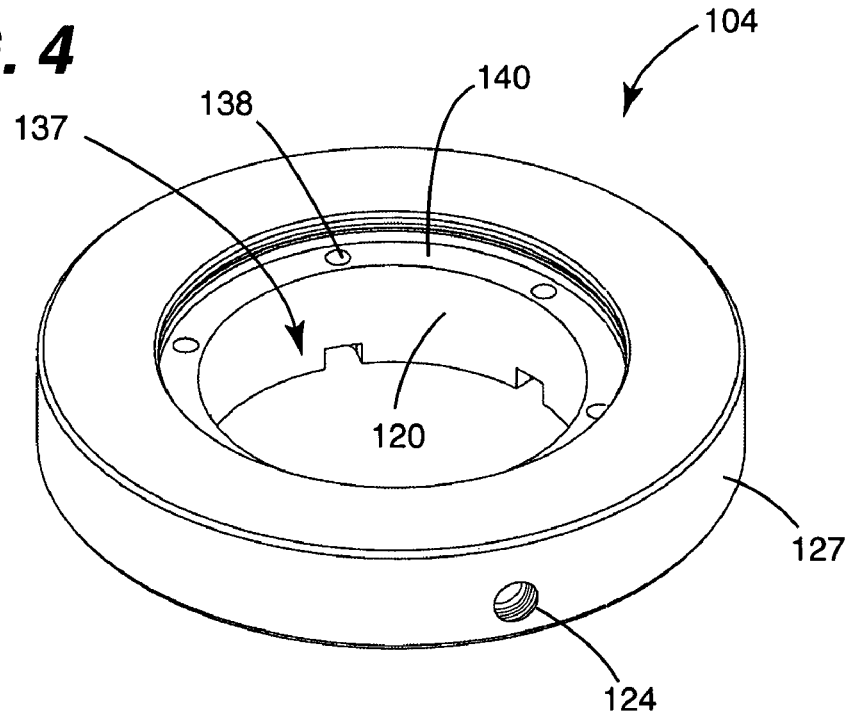
FIG. 4 is a top perspective view of an adapter of the stripper rubber connection system of FIG. 1.
Figure 5:
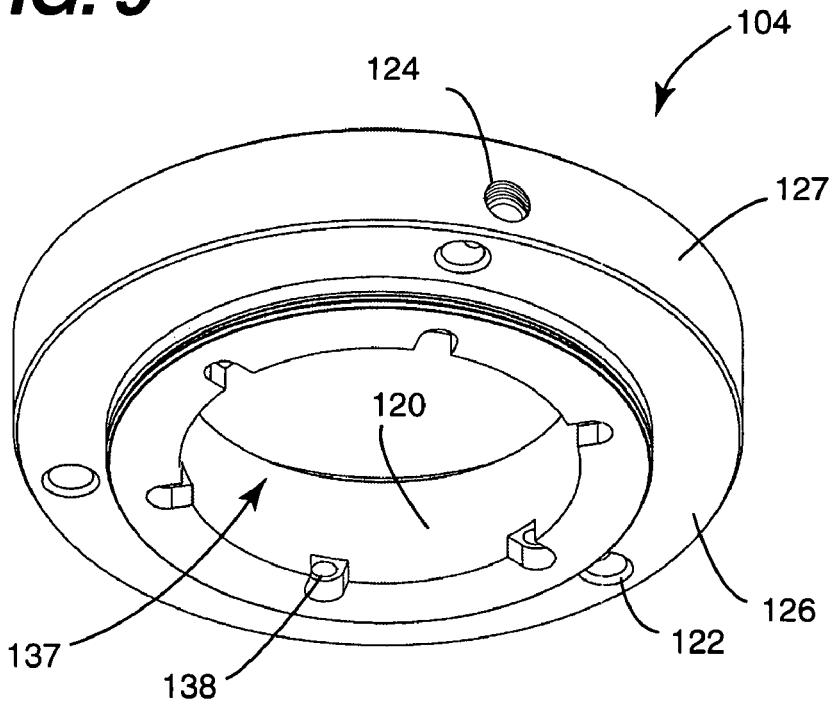
FIG. 5 is a bottom perspective view of an adapter of the stripper rubber connection system of FIG. 1.

As shown in FIGS. 1-3, each one of the retention members 106 includes an adapter engaging portion 130 (i.e., a head portion) and an engagement pin engaging portion 132 (i.e., a tip portion), and is retractably engagable within a respective one of the retention member bores 124. The adapter engaging portion 130 is configured for allowing the respective retention member 106 to be selectively translated along a longitudinal axis of an engaged one of the retention member bores 124 in an engagement direction (i.e., a first direction that is toward the respective engagement pin) and a disengagement direction (i.e., a second direction that is away from the respective engagement pin).

Each one of the engagement pins 118 includes a retention member engaging portion 134 (i.e., receives a tip portion of a retention member). The retention member engaging portion 134 is configured and positioned such that it is exposed within the aperture 122 of the engagement pin bore 122 in which the respective engagement pin 118 is positioned. When the stripper rubber 102 and the adapter 104 are positioned such that the engagement pins 118 are disposed within the engagement pin bores 122, the engagement pin engaging portion 132 of each retention member 106 lockingly engages the retention member engaging portion 134 of the respective one of the engagement pins upon sufficient displacement of each retention member 106 in the engagement direction from a disengaged position (i.e., a position thereby allowing insertion of an engagement pin into the respective engagement pin bore 122). In this manner, the retention members 106 and the engagement pins 118 are jointly configured for selectively precluding withdrawal of the respective engagement pin 118 from within the respective engagement pin bore 122. To allow the stripper rubber 102 to be detached from the adapter 104 once attached, the engagement pin engaging portion 132 of each one of the retention members 106 disengages from the retention member engaging portion 134 of the respective one of the engagement pins 118 upon sufficient displacement in the disengagement direction. In this manner, the retention members 106 and the engagement pins 118 are jointly configured for selectively allowing withdrawal of the engagement pins 118 from within the respective one of the engagement pin bores 122.

As shown, the retention member engaging portion 134 of each engagement pin 118 and the engagement pin engaging portion 132 of each retention member 106 is straight (i.e., non-tapered). Thus, engagement of the retention members 106 with the engagement pins 118 result in minimal, if not negligible, biasing of the stripper rubber 102 toward the adapter 104. However, it is disclosed herein that the retention member engaging portion 134 of each engagement pin 118 and the engagement pin engaging portion 132 of each retention member 106 can be made in a manner (e.g., tapered) whereby engagement of the retention members 106 with the engagement pins 118 biases the stripper rubber 102 toward the adapter 204.

As shown in FIGS. 1-3, selective translation of the retention members 106 is provided for via the adapter engaging portion 130 of each retention member 106 having threads that engage mating threads of the respective retention member bore 124. Thus, rotation of each retention member 106 in a first rotational direction causes translation in the engagement direction and rotation of each retention member 106 in a second rotational direction causes translation in the disengagement direction. Such threaded engagement is one example of facilitating selective translation of the retention members 106 within the retention member bores 124.

It is disclosed herein that the present invention is not limited to a particular arrangement for allowing selective translation of the retention members 106 within the retention member bores 124. A skilled person will appreciate that other arrangements for allowing selective translation of retention members within retention member bores can be used in place of the threaded arrangement. One example of such other arrangements is a twist-lock arrangement where a retention member is slid to a depth in the respective retention member bore where it is engaged with respective engagement pins, and is then locked in place by being twisted a fraction of a complete rotation. In such an arrangement, it can be useful to implement some form of anti-rotation mechanism to prevent unintentional rotation of the retention member. Another example of such other arrangements is where a retention member is slidably and captive disposed within a respective retention member bore, being spring biased in the engagement direction such to it is manually displaced to in the disengaged position for along the an engagement pin to be fully inserted within a respective engagement pin bore.

With respect to attaching the adapter 104 to the drilling head equipment, a surface 136 adjacent a central bore 137 of the adapter 104 (FIGS. 4 and 5) includes a plurality of fastener bores 138. Each one of the fastener bores 138 extends substantially parallel to the central bore 137 for facilitating connection of the adapter 104 to the drilling head equipment. The fastener bores 138 are spaced around the central bore 137.

Preferably, but not necessarily, the adapter 104 is generally cylindrical shaped having an inner surface 140 that encompasses the central bore 137. The fastener bores 138 extend through the inner surface 140.

Various approaches for attaching the adapter 104 to the drilling head equipment are known. Numerous variations of the present invention will be apparent to those of ordinary skill in the art from the preceding exemplary description. For example, an adapter of the present invention may be connected to the drilling head by any suitable means other than bolting. Examples of such other means include, but are not limited to, welding and screwing (e.g., a threaded adapter may be screwed onto a threaded barrel).

Figure 6:
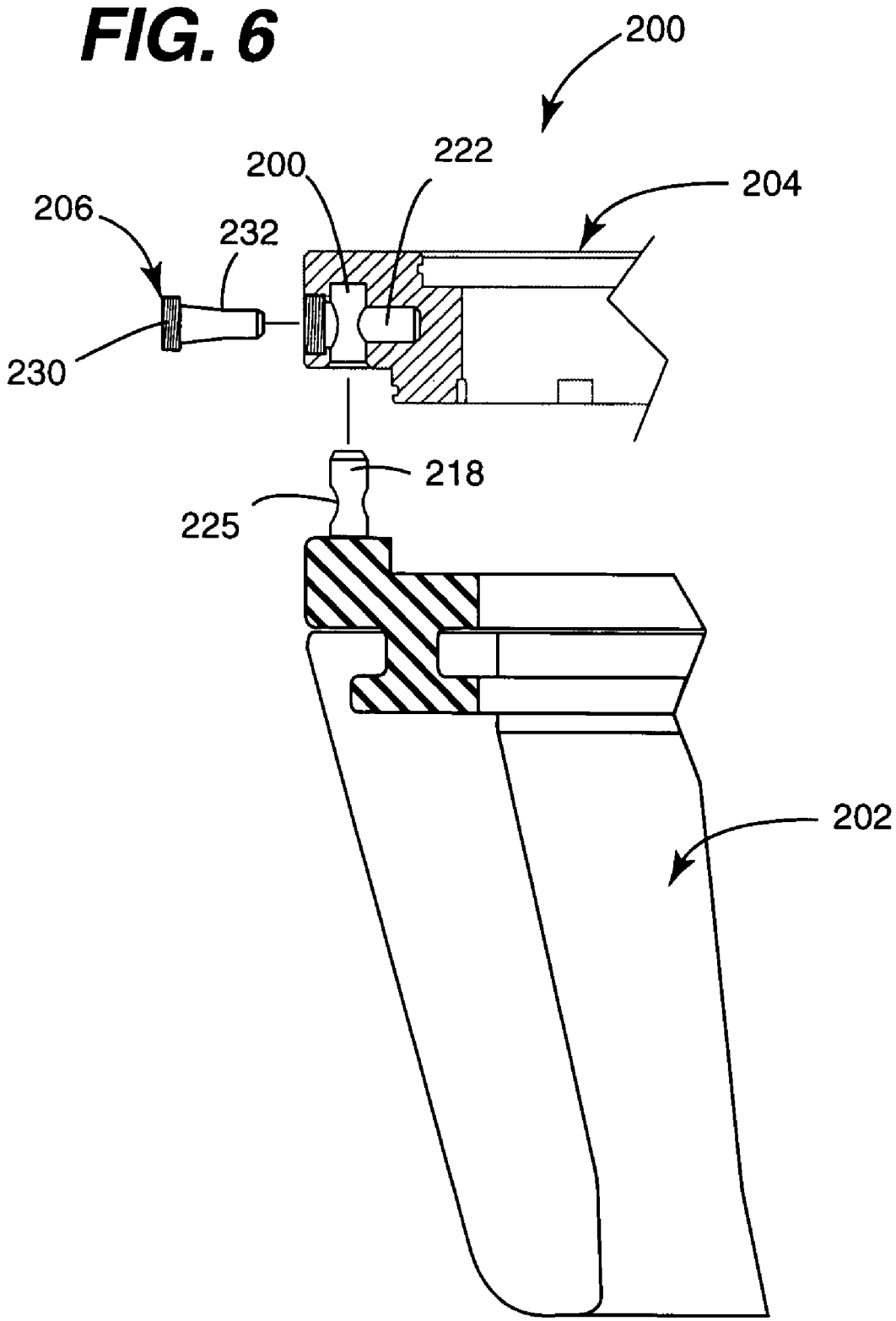
FIG. 6 shows a second embodiment of a stripper rubber connection system in accordance with the present invention.

The engagement pins 118, the retention members 106, the engagement pin bores 122 and the retention member bores 124 shown in FIGS. 1-5 jointly represent a first embodiment of a stripper rubber connection arrangement in accordance with the present invention. FIG. 6 shows an embodiment of a system 200 for disconnectably connecting a stripper rubber to drilling head equipment in accordance with the present invention. The system 200 is the same as the system 100 of FIGS. 1-5 with the following exceptions. Thus, elements of the system 200 that are identical to those of the system 100 will be denoted using the same reference numeral for the same element of the system 100.

The stripper rubber connection arrangement of the system 200 is an alternate embodiment with respect to the stripper rubber connection arrangement of the system 100. The stripper rubber connection arrangement of the system 200 includes a plurality of engagement pins 218, retention members 206, engagement pin bores 222 and retention member bores 224 (one each shown). A longitudinal axis of each engagement pin bore 222 intersects a longitudinal axis of each retention member bore 224.

Each retention member 206 includes a tapered engagement pin engaging portion 232 and an adapter engaging portion 230, and is retractably engagable within a respective one of the retention member bores 224. The adapter engaging portion 230 is configured for allowing the retention member 206 to be selectively translated along the longitudinal axis of an engaged one of the retention member bores 224 in the engagement direction and the disengagement direction. The tapered engagement pin engaging portion 232 engages a mating tapered aperture 225 within a respective one of the engagement pins 218 whereby such engagement biases the stripper rubber 102 toward the adapter 104. Alternatively, the tapered engagement pin engaging portion 232 and the tapered aperture 225 can both be made non-tapered such that engagement of the retention members 206 with the engagement pins 118 result in minimal, if not negligible, biasing of the stripper rubber 102 toward the adapter 104.

Alternatively, with respect to the system 200, the tip portion of the retention members 206 and the tip receiving portion of the engagement pins 218 can be configured such that a tip receiving portion of each engagement pin 218 does not extend fully therethrough and the tip portion of the retention members 206 are correspondingly truncated with respect to those shown. It is disclosed herein that the present invention is not limited to a particular shape of such truncated tip portion and tip receiving portion. Examples of suitable shapes, include, but are not limited to, pointed, flat, rounded, cylindrical, and the like.

It is good practice to periodically replace or maintain stripper rubbers because stripper rubbers tend to wear out. To replace a stripper rubber, the stripper rubber must be disconnected from the drilling head equipment. To disconnect a stripper rubber pursuant to the present invention, it is a simple matter of rotating each retention member such that each retention member retracts a required distance to disengage from the respective engagement pin. A new stripper rubber can then be installed by inserting engagement pins thereof into the engagement pin bores, followed by engaging the retention members to a sufficient depth in the retention member bores such that each retention member engages a respective engagement pin.

Although the invention has been described with reference to several exemplary embodiments, it is understood that the words that have been used are words of description and illustration, rather than words of limitation. Changes may be made within the purview of the appended claims, as presently stated and as amended, without departing from the scope and spirit of the invention in all its aspects. Although the invention has been described with reference to particular means, materials and embodiments, the invention is not intended to be limited to the particulars disclosed; rather, the invention extends to all functionally equivalent technologies, structures, methods and uses such as are within the scope of the appended claims.

What is claimed is:

1. A system for selectively connecting a stripper rubber to drilling head equipment, the system comprising:

a stripper rubber including an insert, wherein the insert has an engagement member extending vertically therefrom;

an adapter configured for being connected between the drilling head equipment and the stripper rubber, wherein the adapter includes a central bore, an engagement member bore substantially parallel to the central bore, a retention member bore substantially perpendicular to the central bore, and attachment means configured for allowing the adapter to be fixedly attached to a mating portion of said drilling head equipment, wherein the engagement member bore intersects the retention member bore and includes a threaded engagement structure provided therein; and a retention member including an adapter engaging portion and an engagement member engaging portion, wherein the adapter engaging portion and the engagement member engaging portion are substantially concentric to each other along a rotational axis of the retention member, wherein the adapter engaging portion of the retention member is threadedly engaged with the threaded engagement structure of the retention member bore such that rotation of the retention member in a first rotational direction causes displacement thereof along a length of the retention member bore in a direction toward said intersecting engagement member bore and such that rotation of the retention member in a second rotational direction opposite the first rotational direction causes displacement thereof along a length of the retention member bore in a direction away from the central bore, wherein the engagement member engaging portion of the retention member lockingly engages the engagement member in response to rotation of the retention member in the first rotational direction causing sufficient linear displacement of the retention member along the length of the retention member bore in the direction toward the central bore when the engagement member is disposed within the engagement member bore thereby precluding withdrawal of the engagement member from within the engagement member bore, and wherein the engagement member engaging portion of the retention member disengages from the engagement member in response to rotation of the retention member in the second rotational direction causing sufficient linear displacement of the retention member along the length of the retention member bore in the direction away from said intersecting engagement member bore when the engagement member is disposed within the engagement member bore thereby allowing withdrawal of the engagement member from within the engagement member bore.

2. The system of claim 1 wherein:

the engagement member bore intersects the retention member bore to form an aperture therebetween; and the retention member engages the engagement members through the aperture.

3. The system of claim 1 wherein:

the retention member includes a tapered engagement portion;

the engagement member includes a tapered engagement portion such that engagement of the retention member with the engagement member causes the tapered engagement portion of the retention member to engage the tapered engagement portion of the engagement member for biasing the stripper rubber toward to adapter.

4. The system of claim 1 wherein:

a tip portion of the retention member is configured for engaging a mating tip receiving portion of the engagement member; and the mating tip receiving portion extends through a side face of the engagement member.

5. The system of claim 1 wherein the engagement member includes a threaded end and a body end, whereby the threaded end of the engagement member is threadedly attach to the stripper rubber insert and the body end of the engagement member is insertable into the engagement member bore.

6. The system of claim 1 wherein said attachment means includes a surface adjacent the central bore comprising a plurality of fastener bores each extending substantially parallel to the central bore for facilitating connection of the adapter to said drilling head equipment.

7. The system of claim 6 wherein said fastener bores are spaced around the central bore.

8. The system of claim 7 wherein:

the adapter is generally cylindrical shaped having an exterior perimeter edge and an inner surface;

the inner surface encompasses the central bore;

the retention member bore extends through the exterior perimeter edge; and said fastener bores extend through the inner surface.

9. The system of claim 1 wherein:

the adapter is generally cylindrical shaped having an exterior perimeter edge and an inner surface;

the inner surface encompasses the central bore;

the retention member bore extends through the exterior perimeter edge;

said fastener bores extend through the inner surface; and said fastener bores are spaced around the central bore.

10. The system of claim 1 wherein the retention member bore is substantially perpendicular to the engagement members bore.

11. The system of claim 10 wherein:

the adapter is generally cylindrical shaped having an exterior perimeter edge and an inner surface;

the inner surface encompasses the central bore;

the retention member bore extends through the exterior perimeter edge;

said fastener bores extend through the inner surface; and said fastener bores are spaced around the central bore.

12. The system of claim 11 wherein the engagement member includes a threaded end and a body end, whereby the threaded end of the engagement member is threadedly attach to the stripper rubber insert and the body end of the engagement member is insertable into the engagement member bore.

* * * * *